US006550527B1

(12) United States Patent
Thoene et al.

(10) Patent No.: US 6,550,527 B1
(45) Date of Patent: Apr. 22, 2003

(54) DEVICE FOR CONTINUOUS CASTING

(75) Inventors: Heinrich Thoene, Losenstein (AT); Klaus Schoenhuber, Linz (AT); Franz Wimmer, Riedau (AT)

(73) Assignee: Voest-Alpine Industrienlagenbau GmbH (AT)

( * ) Notice: Subject to any disclaimer, the term of this patent is extended or adjusted under 35 U.S.C. 154(b) by 0 days.

(21) Appl. No.: 09/508,233

(22) PCT Filed: Aug. 26, 1998

(86) PCT No.: PCT/AT98/00203

§ 371 (c)(1),
(2), (4) Date: May 25, 2000

(87) PCT Pub. No.: WO99/12676

PCT Pub. Date: Mar. 18, 1999

(30) Foreign Application Priority Data

Sep. 8, 1997 (AT) ..... 1493/97

(51) Int. Cl.[7] ..... B22D 11/04
(52) U.S. Cl. ..... 164/416; 164/418
(58) Field of Search ..... 164/416, 418, 164/478

(56) References Cited

U.S. PATENT DOCUMENTS 3,881,544 A * 5/1975 Botta Jr. et al. ..... 164/260
4,807,691 A * 2/1989 Schneider et al. ..... 164/416
5,623,983 A * 4/1997 Thone et al. ..... 164/416
5,642,769 A * 7/1997 Thone et al. ..... 164/416

FOREIGN PATENT DOCUMENTS

| | | |
|---|---|---|
| DE | 1954780 | 6/1966 |
| DE | 1288249 | 1/1969 |
| DE | 2248066 | 4/1974 |
| EP | 0150357 | 7/1985 |

* cited by examiner

*Primary Examiner*—M. Alexandra Elve
*Assistant Examiner*—Len Tran
(74) *Attorney, Agent, or Firm*—Ostrolenk, Faber, Gerb & Soffen, LLP

(57) ABSTRACT

In a continuous-casting apparatus with a mold-supporting device (4) and a mold (1) mounted to oscillate relative to the supporting device, the mold (1) is supported via guide elements (7, 10) extending approximately transversely to the direction of oscillation arranged approximately parallel to one another and, relative to the direction of oscillation (III), at a distance (12) one above the other. At least one first guide element (7) extends from the mold-supporting device (4) towards the mold (1) in a first direction (I) and at least one second guide element (10) extends from the mold-supporting device (4) towards the mold (I) in a direction (II) opposite to the first direction (I).

23 Claims, 7 Drawing Sheets

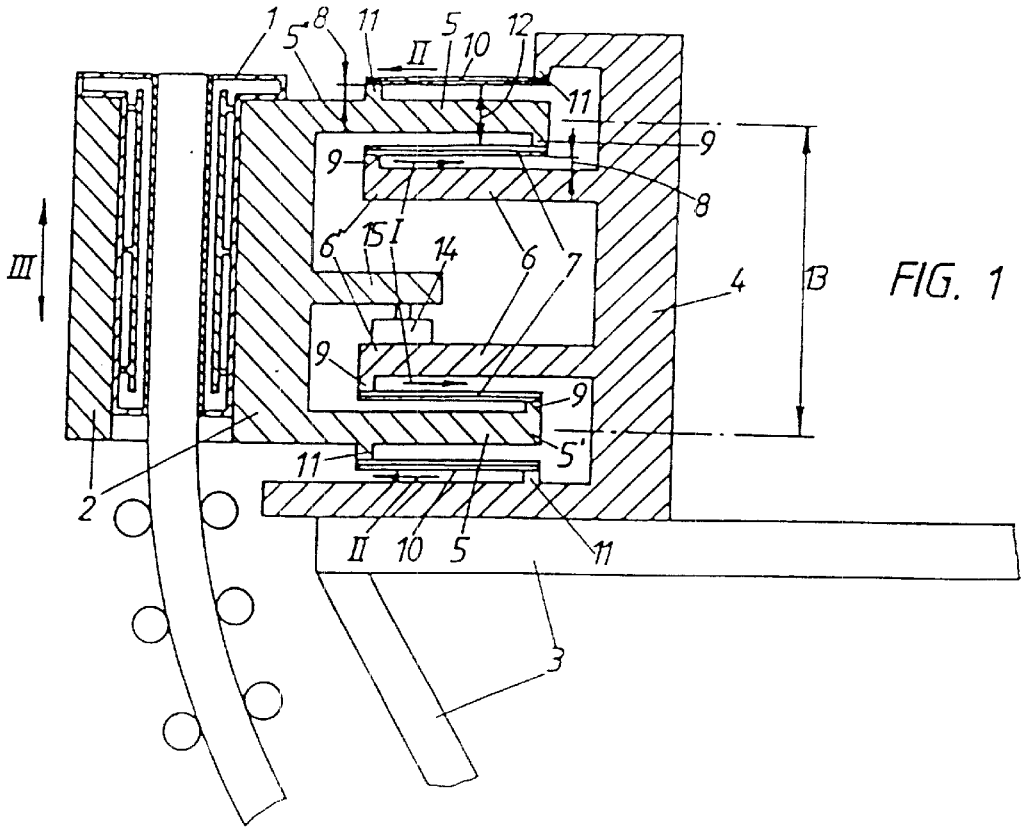
FIG. 1
FIG. 2
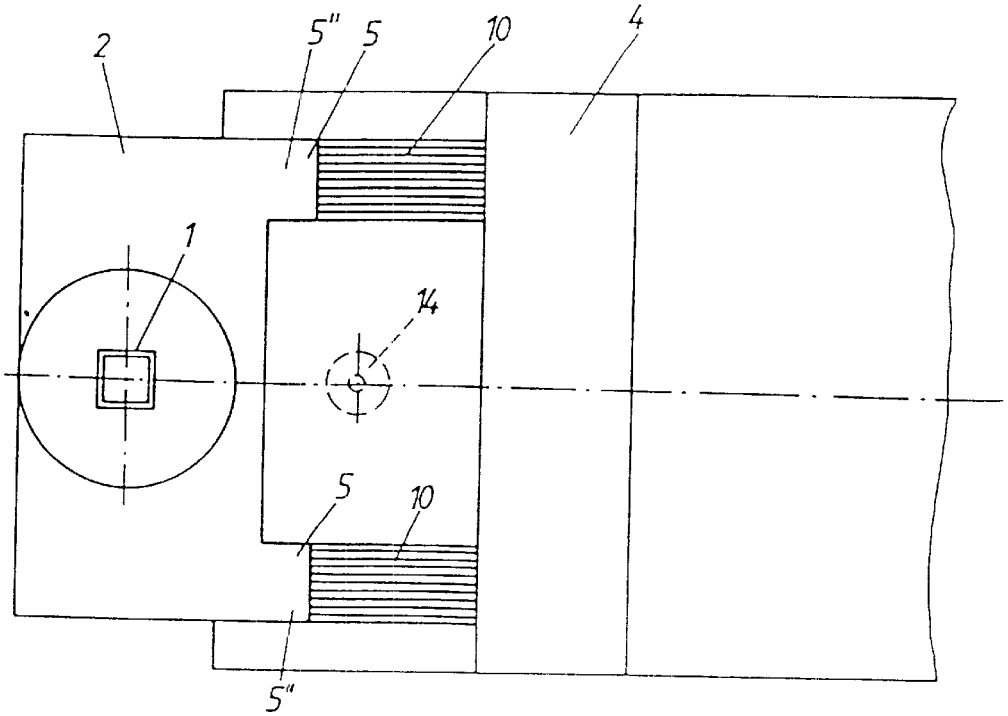

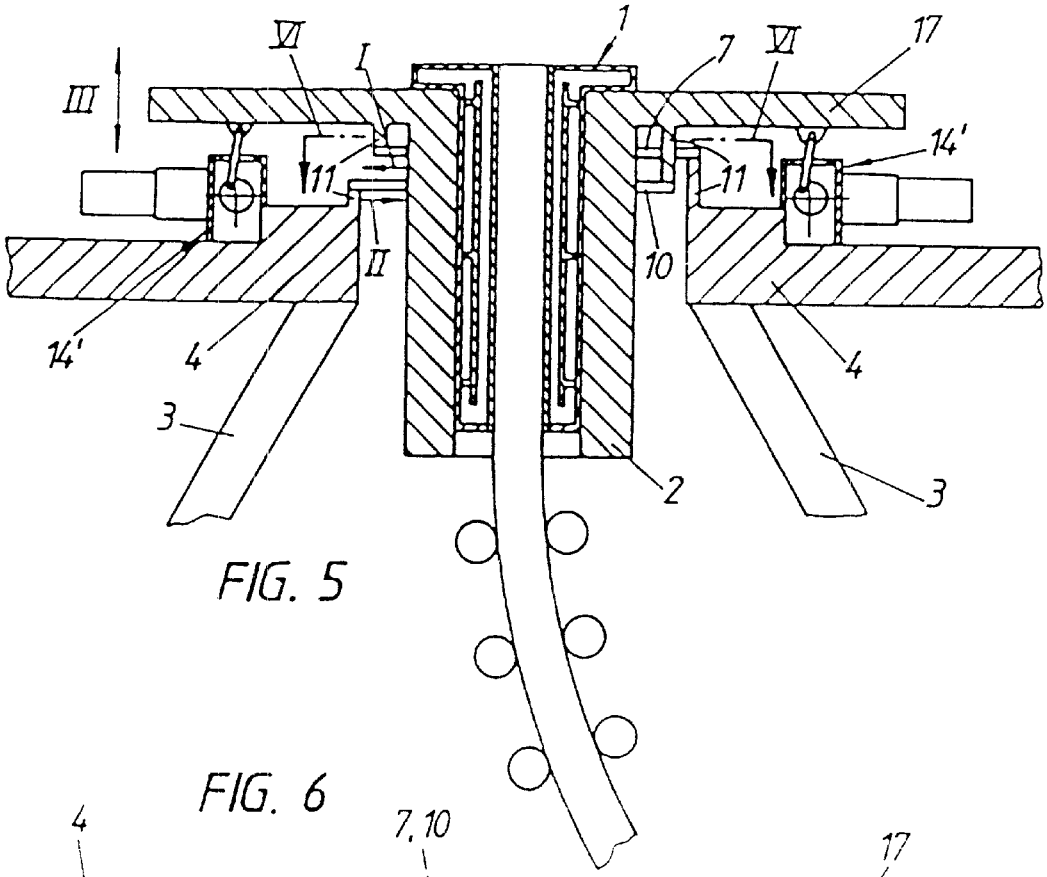
FIG. 5
FIG. 6
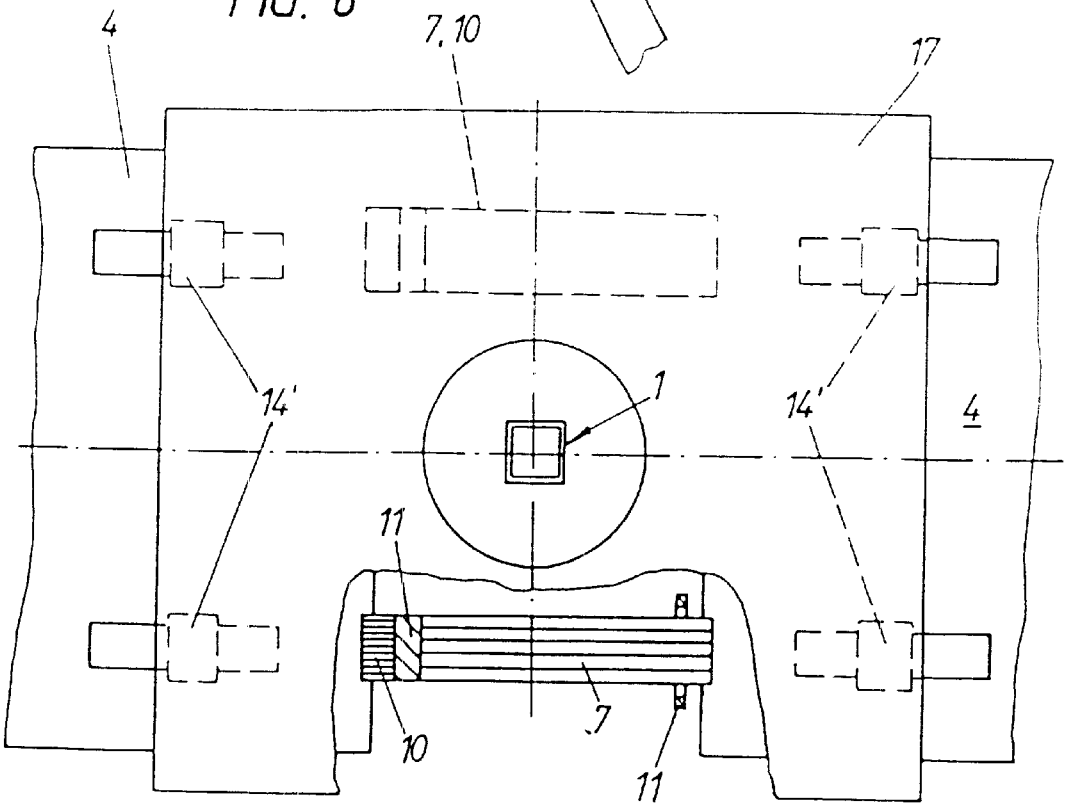

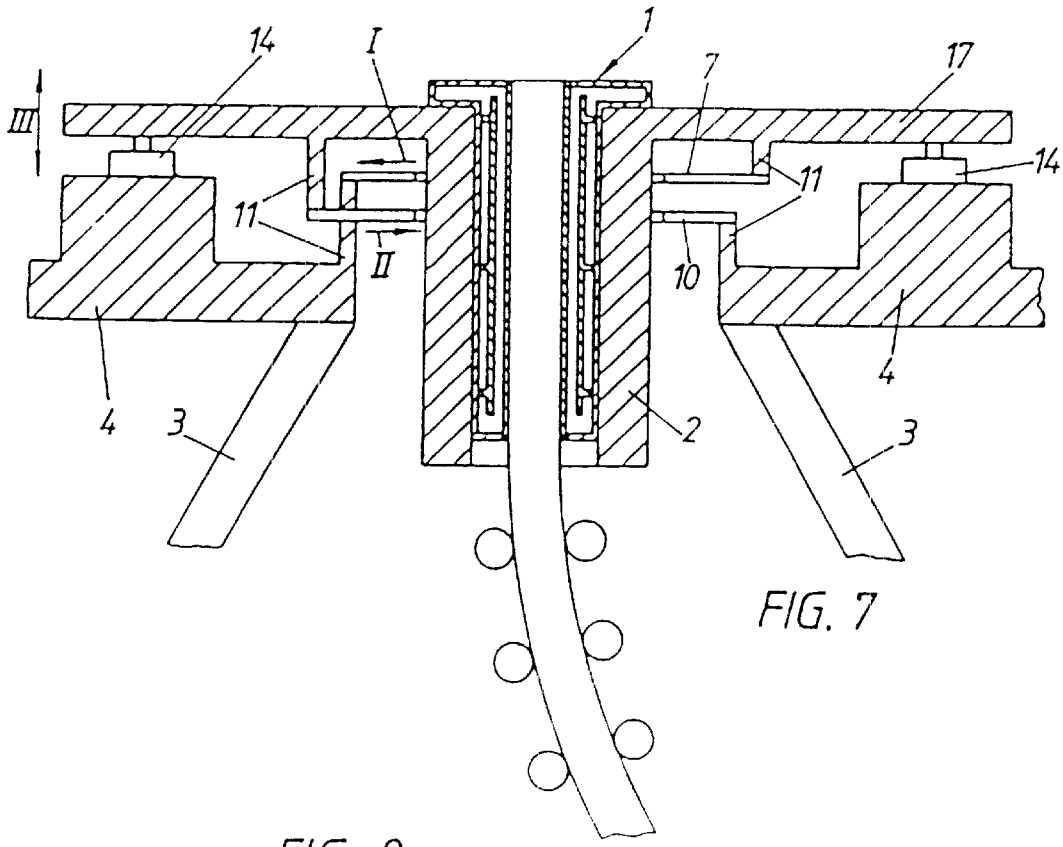
FIG. 7
FIG. 8
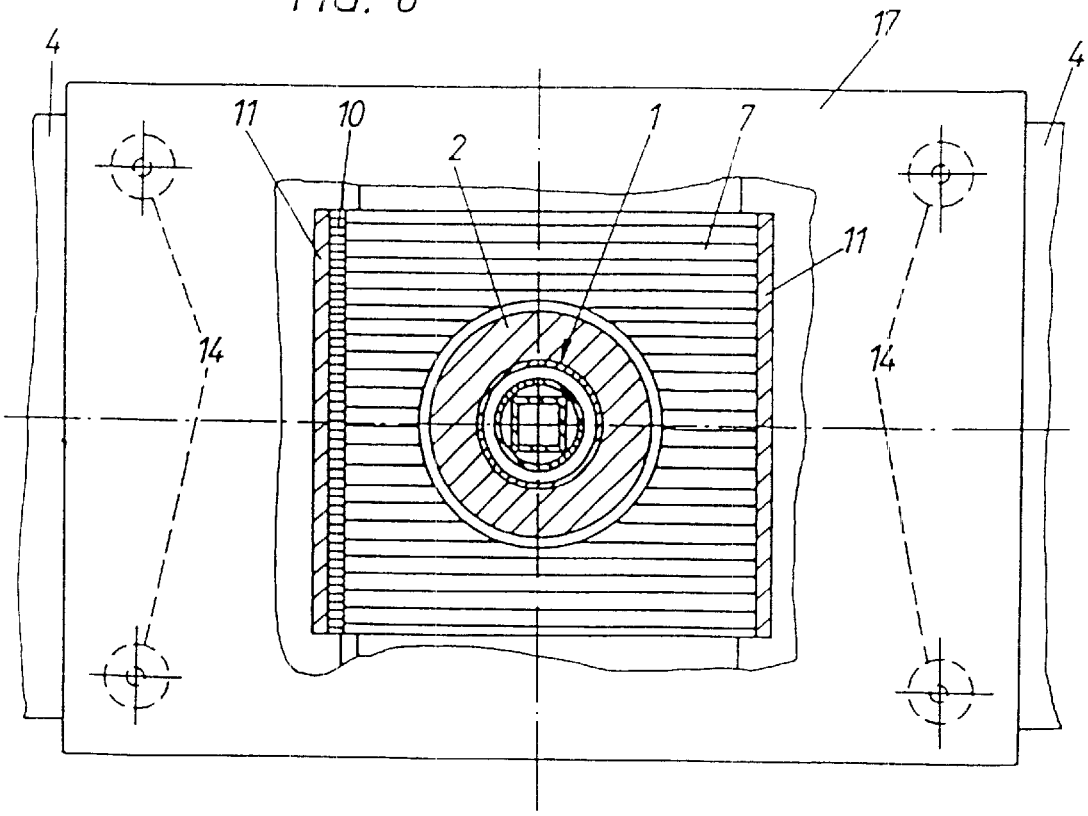

DEVICE FOR CONTINUOUS CASTING

BACKGROUND OF THE INVENTION

1. Field of the Invention

The invention relates to a continuous-casting apparatus, in particular for the continuous casting of steel, with a mould-supporting device and with a mould mounted so as to oscillate relative to the latter, the mould being supported on the mould-supporting device via guide elements extending approximately transversely to the direction of oscillation and absorbing forces in the elastic range, the guide elements being arranged approximately parallel to one another and, in the direction of oscillation, at a distance one above the other.

2. Related Art

A continuous-casting apparatus of this type is known from DE-A-2 248 066. In this continuous-casting apparatus, the mould is guided laterally via two spring assemblies arranged parallel to one another and one above the other and formed by band springs. Oscillation is brought about by a hydraulic cylinder which engages, on the one hand, on the supporting structure and, on the other hand, on a bracket of the mould. In this case, the two spring assemblies, which are arranged on one mould side in each case and are firmly clamped, on the one hand, to the supporting structure end, on the other hand, to the mould, have to absorb the guide forces, that is to say they are subjected to tensile or compressive load. On account of the compressive load, they have to be dimensioned to the buckling limit, thus resulting in a large thickness of the spring assemblies, specifically a far greater thickness than is necessary for the maximum tensile forces which occur.

In order, at the same time, to keep the bending stresses within the permissible range, it is necessary to dimension the spring assemblies with an appropriate length. Due to the large thickness of the spring assemblies, higher drive forces arise, that is to say the oscillation drive has to be made correspondingly more robust. Another disadvantage of this known design is that the life expectancy of the spring assemblies is reduced because of the high alternating bending stress occurring due to the large thickness, and, moreover, that, because of the large overall length of the spring assemblies, an increased amount of space is required in order to keep the alternating bending stress within a permissible scope. However, because of this, the accuracy with which the mould is guided is impaired, especially since the longer spring assemblies give rise to a more pronounced elastic behaviour, thus resulting, in turn, in greater deflections and deviations of the mould from the desired guide path. Furthermore, where longer spring assemblies are concerned, thermal influences become noticeable to an increased extent, specifically due to deviations of the mould from the desired guide path.

EP-A-150 357 discloses a billet guide for a continuous-casting mould, in which the mould is guided by means of a leaf spring which is clamped in a bridge-like manner at both ends in a spring carrier, the mould engaging on the leaf spring in the middle of the latter. Such a guide device makes it necessary to have a very large amount of space in the direction of the leaf-spring axis. Such a guide can therefore be provided only where there is sufficient space at the side of the mould. This is usually not the case where bloom or billet installations are concerned, and therefore this type of guide cannot be used for such installations.

The invention is aimed at avoiding these disadvantages and difficulties, and its set object is to provide a continuous-casting apparatus of the type described in the introduction, for which, in addition to a high degree of accuracy in the guidance of the mould, only a small amount of space is required and only low drive forces are needed for the oscillation drive. In particular, the space required is to be so small that it is possible in a simple way to use the continuous-casting apparatus for bloom and billet installation.

BRIEF DESCRIPTION OF THE INVENTION

This object is achieved, according to the invention, in that at least one first guide element extends from the mould-supporting device towards the mould in a first direction and at least one second guide element extends from the mould-supporting device towards the mould in a direction opposite to the first direction.

According to a preferred embodiment, at least one supporting arm extending towards the mould-supporting device is provided on the mould and at least one supporting arm extending towards the mould is provided on the mould-supporting device, the said supporting arms being arranged approximately parallel to one another and, as seen in the direction of oscillation, so as approximately to overlap one another, and at least one guide element extends from the end region of one supporting arm towards the end region of the other supporting arm and is in each case fastened there itself.

For the non-tilt support of the mould, it is expedient to provide in each case at least two first guide elements and two second guide elements, in each case groups formed by a first and a second guide element being arranged at a distance from one another which is provided in the direction of oscillation. In this embodiment, the oscillation drive does not execute any guide forces. Should the mould be supported in a non-tilt manner via the oscillation drive, that is to say is prevented from tilting by the oscillation drive, for example is set in oscillation via eccentric drives, as described in EP-A-0 150 357, however, a single group formed by a first and a second guide element is sufficient.

For arcuate moulds, the continuous-casting apparatus is advantageously characterized in that a first guide element and a second guide element arranged approximately parallel to the latter are provided at an angle to a further first guide element and to the second guide element arranged approximately parallel thereto, for an arcuate mould the longitudinal axes of the guide elements advantageously being oriented approximately on radial lines of the arc defined by the arcuate mould.

The first and the second guide elements expediently form a structural unit in each case with a supporting arm 5. This embodiment allows a simple design and a simple installation of the guide elements or else a simple exchange of these. Moreover, the guide elements can be provided, in a particularly simple way in design terms, where they can be accommodated most easily with regard to space.

The guide elements are advantageously formed by spring bands, in particular in each case by spring-band assemblies, but it is also possible to use ropes, bars and/or diaphragms as guide elements.

The guide elements are expediently formed from steel or plastic, such as, for example, carbon fibre or glass fibre.

BRIEF DESCRIPTION OF THE DRAWINGS

The invention is explained in more detail below with reference to several exemplary embodiments illustrated diagrammatically in the drawing, FIG. 1 illustrating a section through a billet mould and FIG. 2 a plan view of this mould.

FIGS. 5, 6 and 7, 8 show further embodiments of the invention, FIGS. 5 and 7 illustrating sections in a similar way to FIG. 1 and FIGS. 6 and 8 illustrating part-sections along the lines VI/VI and VIII/VIII of FIGS. 5 and 7.

DETAILED DESCRIPTION OF THE INVENTION

Figure 3:
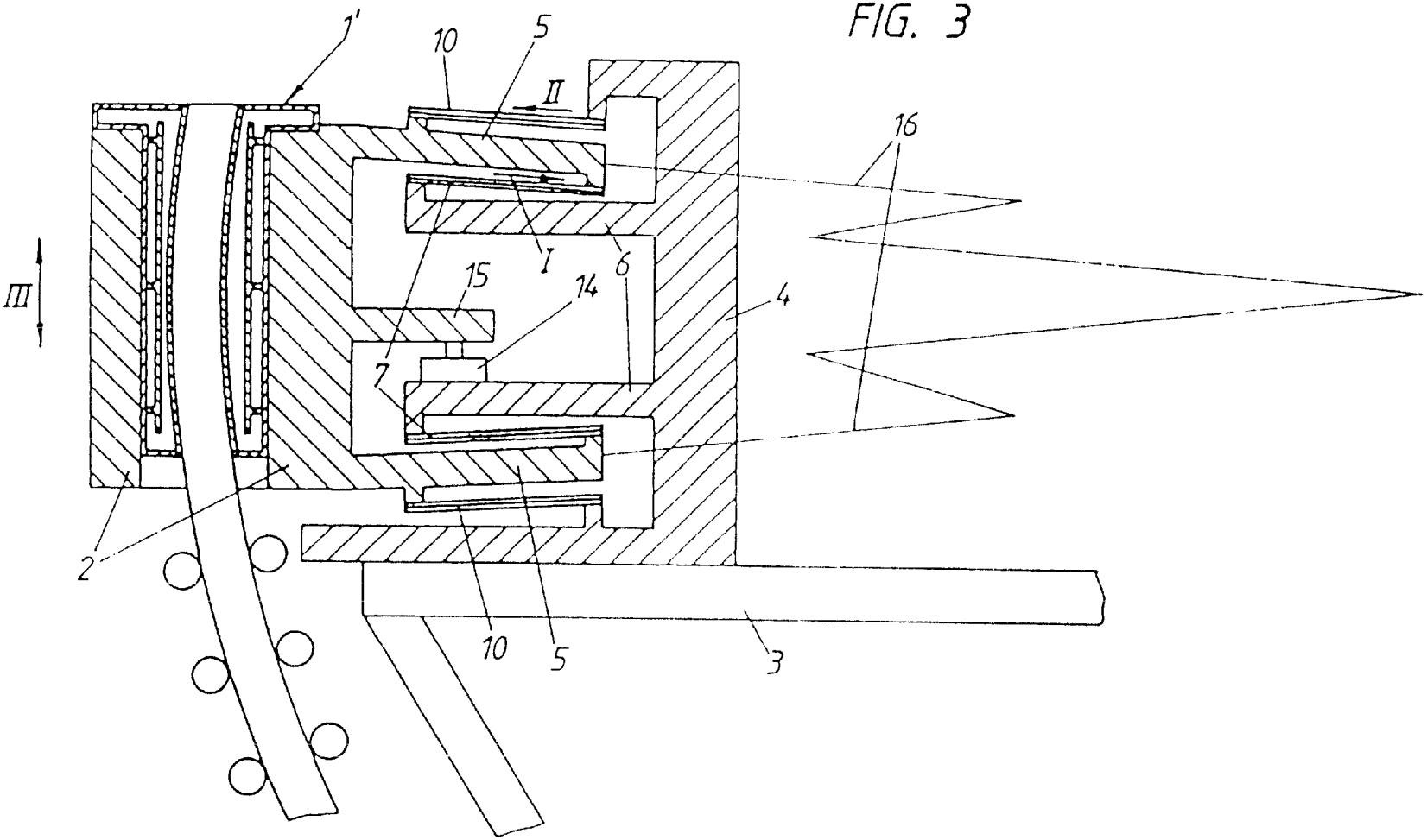
FIGS. 3 and 4 show embodiments of arcuate moulds, likewise in section.

1 designates a tubular mould, provided with internal cooling, of a continuous-casting apparatus for the casting of a billet. This mould 1, which could also be formed from plates, is inserted in a carrying device 2, such as lifting platform, which may also be designed as a water box for supplying coolant to the mould 1, and is carried by the said lifting platform. A mould-supporting device 4 fastened to the foundation or to a carrying structure 3 serves for supporting the mould 1 relative to the foundation or to a carrying structure fastened to the foundation and, as described below, is connected to the mould 1, that is to say the carrying device 2 of the latter.

Supporting arms 5 arranged in each case at the side of the mould extend away from the mould 1, that is to say from its carrying device 2, to the mould-supporting device 4, specifically, in each case, two supporting arms 5 in the upper region of the longitudinal extent of the mould 1 and two supporting arms 5 in the lower region of the longitudinal extent of the mould 1; altogether four supporting arms 5 are therefore provided. The supporting arms 5 are aligned approximately parallel to one another and are connected rigidly to the carrying device 2.

Four supporting arms 6, which are connected rigidly to the mould-supporting device 4, likewise extend from the mould-supporting device 4 in the direction of the mould 1 and are likewise aligned parallel to one another and approximately parallel to the supporting arms 5 extending from the mould 1 towards the mould-supporting device 4. The supporting arms 5 and 6 are aligned with one another in such a way that, in each case, a supporting arm 5 of the carrying device 2 lies closely adjacent to a supporting arm 6 of the mould-supporting device 4.

In each case one end 5' of a supporting arm 5 of the carrying device 2, the said supporting arm extending away from the mould 1, is connected, via a guide element 7 aligned approximately parallel to the supporting arms 5, 6, to the free end 6' of the supporting arm 6 extending from the mould-supporting device 4 towards the mould 1, specifically via brackets 9 leaving a distance 8 between the guide elements 7 and the supporting arms 5 and 6. Furthermore, other guide elements 10 are provided, which are likewise fastened to brackets 11 which are arranged, on the one hand, on the carrying device 2 or on the initial region 5" of the supporting arms 5 and on the mould-supporting device 4.

As a result, in each case two pairs of closely adjacent guide elements 7 and 10 are obtained, in each pair one guide element 7 extending from the mould-supporting device 4 towards the mould 1 in a first direction I and a second guide element 10 extending from the mould-supporting device 4 towards the mould 1 in a direction II opposite to the first direction I. The guide elements 7, 10 of each pair of guide elements are aligned approximately parallel to one another and, in the direction of oscillation III of the mould 1, are arranged at a distance 12 one above the other; they could also be arranged next to one another. The guide elements 7, 10 may be formed by spring bands, in particular by spring-band assemblies. However, since they have to absorb tensile forces only, they may also be formed by ropes, i.e. cables. Moreover, bars have also proved appropriate for the guide elements 7, 10. If spring bands are used, these are arranged in such a way that they are bend-resistant in the direction transverse to the direction of oscillation III and are bendable in the direction of oscillation III. The guide elements 7, 10 are preferably formed from steel or plastic, such as, for example, with carbon fibre or glass fibre reinforcement.

According to the exemplary embodiment illustrated in FIG. 1, the pairs of guide elements formed in each case by two guide elements 7 and 10 are provided so as to overlap one another, as seen in a plan view of the continuous-casting apparatus, that is to say in the direction of oscillation III. However, this would not necessarily have to be so; they could also be arranged next to one another or one behind the other. If they are arranged one, above the other, a distance 13 extending in the direction of oscillation III of the mould 1 is provided in each case between the pairs of guide elements. The arrangement of altogether four pairs of guide elements 7, 10 ensures that the mould 1 is supported in a non-tilt manner, regardless of an oscillation drive 14.

A hydraulic cylinder provided between the mould-supporting device 4 and the carrying device 2 serves as an oscillation drive 14. According to the exemplary embodiment illustrated in FIG. 1, the hydraulic cylinder 14 is arranged, on the one hand, on one of the supporting arms 6 extending from the mould-supporting device 4 towards the mould 1 and on an additional supporting arm 15 extending from the carrying device 2 towards the mould-supporting device 4. As is apparent particularly from FIG. 2, because of the non-tilt support of the mould 1 a single hydraulic cylinder 14 is sufficient; the latter is arranged centrally between the pair of guide elements 7, 10.

Since the exemplary embodiment illustrated in FIG. 1 concerns a straight mould 1, all the guide elements 7 and 10 are aligned parallel to one another, so that the mould 1 executes a rectilinear oscillation movement.

By virtue of the guide elements 7 and 10 being designed and arranged according to the invention, they only ever absorb tensile forces, so that there is no need for them to be dimensioned to the buckling stress limit. This results in small cross-sectional dimensions for the guide elements 7 and 10, high operating reliability and a high life expectancy for them. Moreover, automatic compensation of thermal expansions takes place, so that guide deviations caused thereby cannot occur. The solution according to the invention is distinguished, furthermore, by a compact design, thus also resulting in lower guide-path deviations due to elastic deformations.

Figure 4:
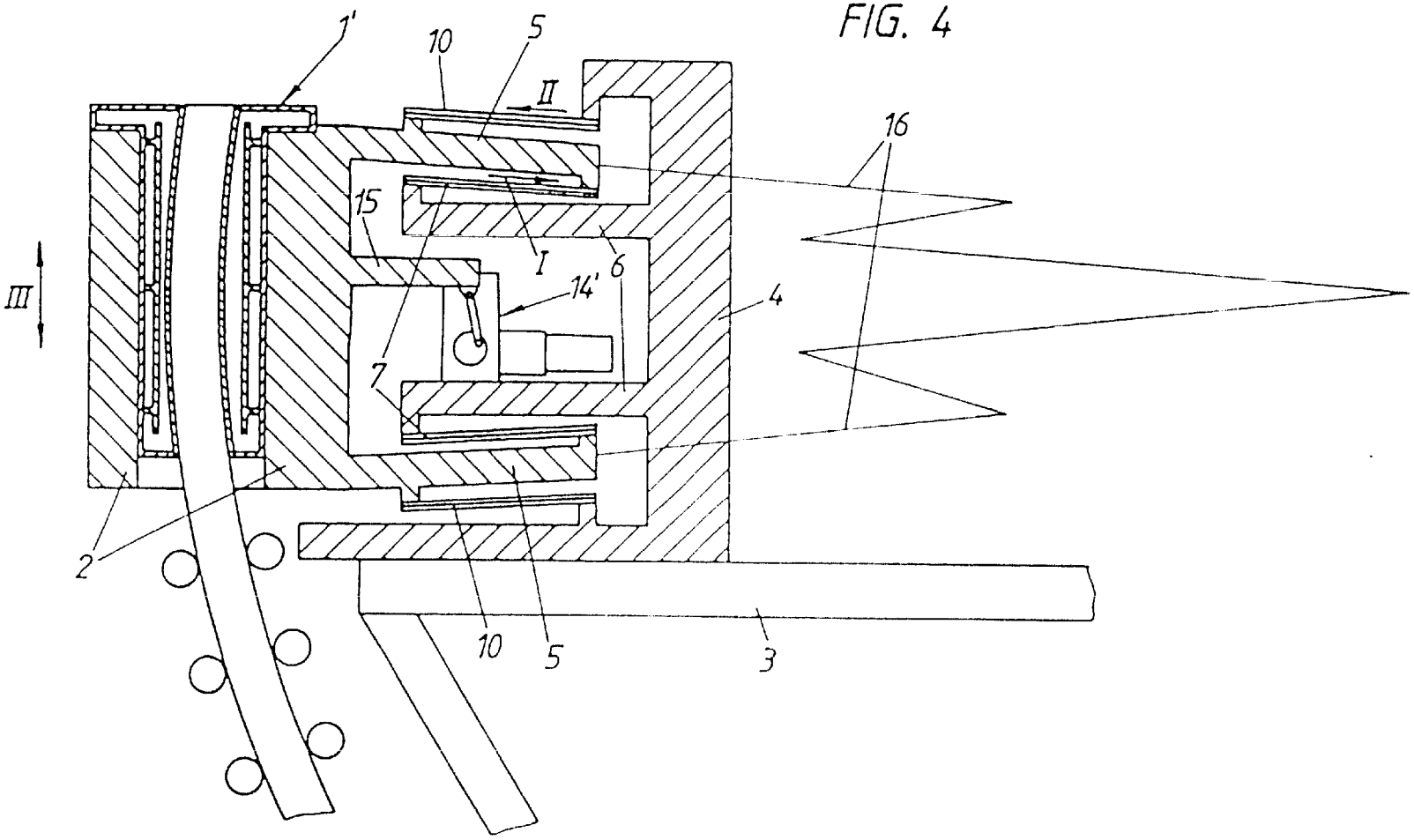

According to the exemplary embodiments illustrated in FIGS. 3 and 4, the guide elements 7, 10 for an arcuate mould 1' are arranged so as to be oriented approximately on radial lines 16 of the arc defined by the mould cavity. According to FIG. 3, a single hydraulic cylinder 14 is likewise provided for generating the oscillation movement, and, according to FIG. 4, a mechanical drive 14' with crank and connecting rod is provided.

FIG. 5 shows an embodiment, in which a single pair of guide elements 7, 10 is provided on each of the two sides of a mould 1, the two pairs of guide elements 7, 10 being arranged at one and the same height. In this case, the mould 1 is supported in a non-tilted manner by means of the oscillation drives 14'. For this purpose, oscillation drives 14', in the exemplary embodiment illustrated in FIG. 5 mechanical oscillation drives 14' running synchronously, are provided on a support plate 17 of the carrying device 2, in each case in the corner regions.

According to the exemplary embodiment illustrated in FIGS. 7 and 8, the guide elements 7 and 10 are designed as diaphragms which extend transversely to the direction of oscillation III and through which the mould 1 and its carrying device 2 pass centrally, that is to say the guide elements 7 and 10 are designed as annular diaphragms. Since only two guide elements 7 and 10 are provided here, which extend in opposite directions I and II according to the invention, four synchronously running hydraulic drives 14, which are arranged in corner regions of a carrying plate 17 of the carrying device 2, are likewise provided for ensuring a non-tilt support of the mould 1.

Figure 10:
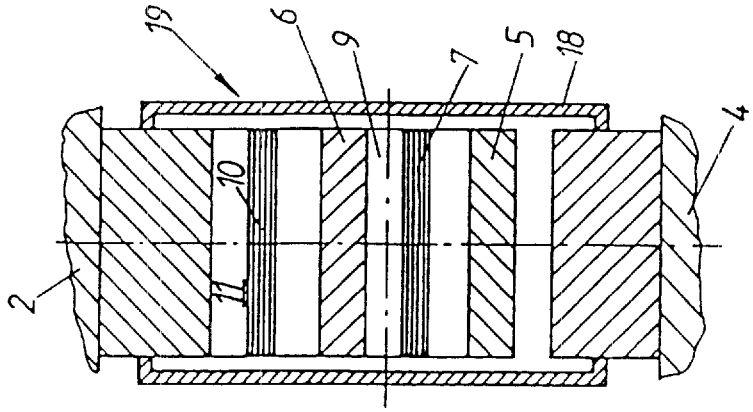
FIG. 10 shows a section along the line X/X of FIG. 9.
Figure 9:
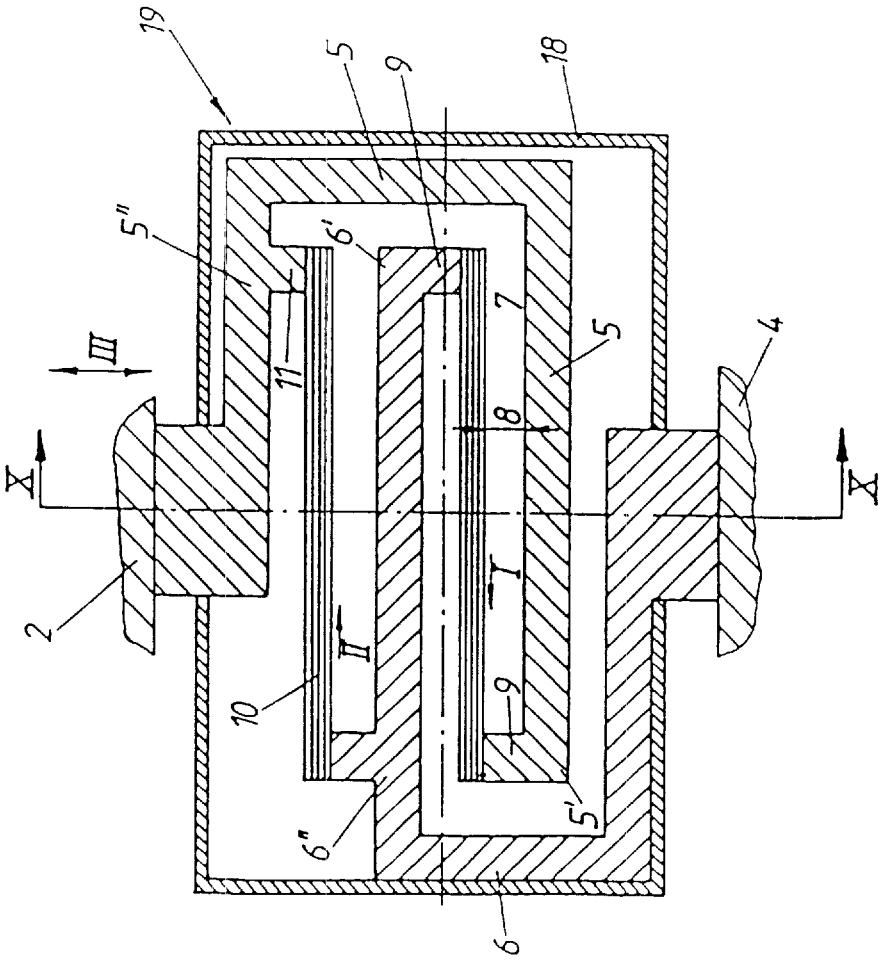
FIG. 9 shows a detail of the invention in section.

FIGS. 9 and 10 illustrate a variant, according to which a pair of guide elements 7, 10 with two guide elements 7, 10 and with the associated supporting arms 5, 6 is combined into a structural unit 19 in a housing 18. The supporting arm 6 assigned to the mould-supporting device 4 passes through the housing 18 centrally on the underside of the said housing, as seen in the longitudinal direction of the latter, and is connected fixedly to the housing-18. The supporting arm 5 assigned to the mould 1 passes through the housing 18 centrally along the longitudinal extent on the opposite side and is movable relative to the housing 18. Both supporting arms 5, 6 are approximately U-shaped, in each case two legs of the U engaging one over the other, so that the U-shaped supporting arms 5, 6 come to rest so as to be nested one in the other.

The guide element 7 is arranged between the end regions 5' and 6' of the supporting arms 5 and 6, respectively, and the guide element 10 is arranged between their initial regions 5" and 6". Here too, the guide elements 7, 10 extend, on the one hand, from the supporting arm 5 assigned to the mould 1 towards the supporting arm 6 assigned to the mould-supporting device 4, now in a first direction I and now in a direction II opposite to the first direction I.

Figure 11:
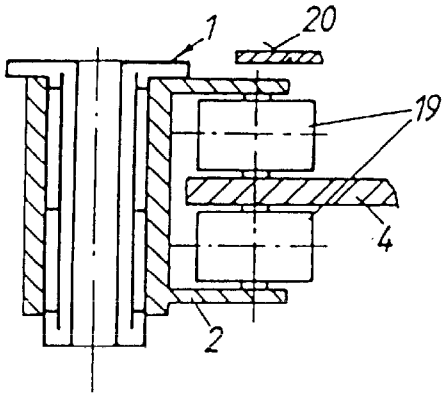
Figure 12:
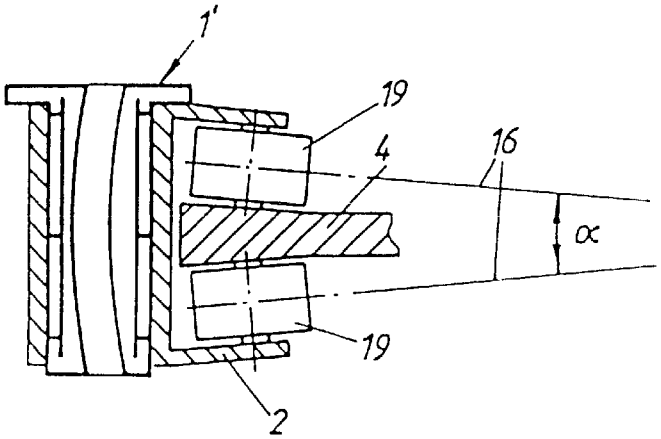

FIGS. 11 to 14 show exemplary embodiments of the invention which are equipped with the structural units 19 illustrated in FIGS. 9 and 10. FIG. 11 shows the arrangement for a mould 1 having a straight mould cavity. FIG. 12 shows an arrangement for an arcuately shaped mould 1', in the latter the two structural units 19 being arranged at an inclination to one another, so that the guide elements 7, 10 of one structural unit 19 form an angle $\alpha$ with the guide elements 7, 10 of the second structural unit 19 which is provided at a distance below the first. Here too, the guide elements 7, 10 lie approximately on radial lines 16 of the arc defined by the arcuate mould cavity.

Figure 13:
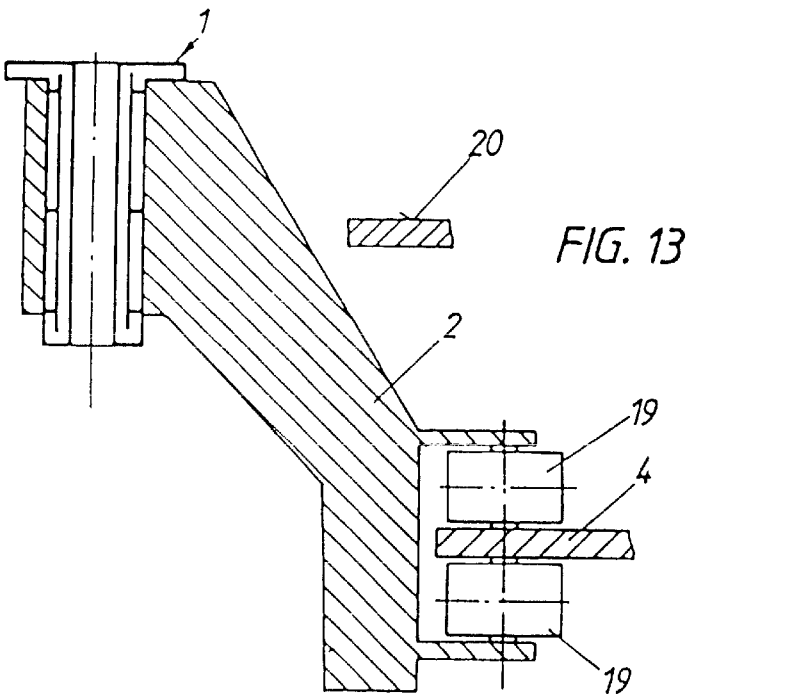
FIGS. 11 to 14 show further embodiments of the invention in an illustration similar to that of FIG. 1.

FIG. 13 illustrates the advantageous arrangement of the structural units 19 at a vertical distance below the mould 1, the advantage of this being that, even if the mould 1 projects above the casting platform 20, the structural units can be accommodated below the casting platform 20 in a position which does not cause any disturbance.

Figure 14:
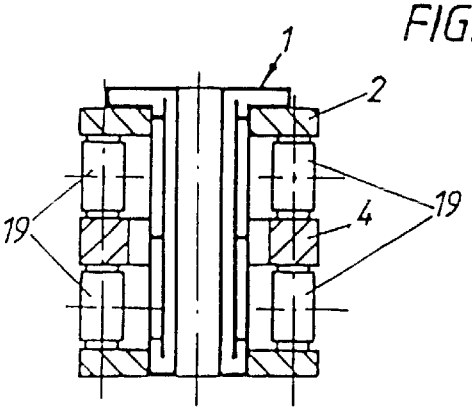

FIG. 14 illustrates an embodiment in which four structural units 19 are provided close to the side of a mould 1, specifically, in each case two being arranged one above the other and, in each case, two being arranged on each side of the mould 1.

The invention is not restricted to the exemplary embodiments illustrated in the drawing, but may be modified in various respects. For example, if the mould-supporting device 4 and the carrying device 2 are appropriately arranged, supporting arms 5, 6 may even be dispensed with. It is also conceivable, furthermore, to support a mould 1 directly on the mould-supporting device 4 via guide elements 7, 10, without a carrying device 2 being interposed.

What is claimed is:

1. A continuous-casting apparatus comprising:

a continuous casting mold;

a mold-supporting device;

a driver operative to oscillate the mold along all axis of vibration relative to the mold-supporting device;

a first group of first and second guide elements that elastically support the mold on the mold-supporting device, the first and second guide elements bring arranged in approximately parallel spaced relationship approximately transversely to the axis of vibration;

a first side of the first guide element being anchored to the mold-supporting device along a first line-segment and extending in a first direction to a second side at which it is attached to the mold along a second line-segment; and a first side of the second guide element being anchored to the mold-supporting device along a third line-segment and extending in a second direction opposite to the first direction to a second side at which it is attached to the mold along a fourth line-segment; and a second group of first and second guide elements, the first and second groups of first and second guide elements being arranged in spaced relationship from one another along the axis of vibration.

2. A continuous-casting apparatus according to claim 1, wherein the guide elements are comprised of assemblies of spring bands.

3. A continuous-casting apparatus according to claim 1, wherein the guide elements are comprised of cables.

4. A continuous-casting apparatus according to claim 1, wherein the guide elements are comprised of bars.

5. A continuous-casting apparatus according to claim 1, wherein the guide elements are comprised of diaphragms.

6. A continuous-casting apparatus according to claim 1 further including:

a first supporting arm that extends from the mold-supporting device toward the mold;

a second supporting arm that extends from the mold toward the mold-supporting device; and wherein:

the first and second supporting arms are arranged approximately parallel overlapping relationship and spaced from each other along the axis of vibration;

the first line-segment lies along a projecting end of the first supporting arm; and the second line-segment lies along a projecting end of the second supporting arm that extends from the mold-supporting device toward the mold.

7. A continuous-casting apparatus according to claim 1, wherein:

the first and second guide elements of each group are arranged approximately parallel to one another; and the guide elements of one group are in non-parallel relationship to the guide elements of the other group.

8. A continuous-casting apparatus according to claim 1, wherein the mold is of arcuate configuration and the guide elements are oriented to extend approximately on radial lines of the arc defined by the arcuate mold.

9. A continuous-casting apparatus according to claim 6, wherein a first and a second guide element together form a structural unit with the attached supporting arms.

10. A continuous-casting apparatus according to claim 1, wherein the guide elements are comprised of steel.

11. A continuous-casting apparatus according to claim 1, wherein the guide elements are comprised of a carbon fibre material.

12. A continuous-casting apparatus according to claim 1, wherein the guide elements are comprised of a glass fibre material.

13. A continuous-casting apparatus according to claim 1, wherein the spacing between the first and second guide elements in each group is small compared to the spacing between the two groups.

14. A continuous-casting apparatus according to claim 6, further including:

third supporting arm that extends from the mold-supporting device toward the mold in approximately parallel overlapping relationship with the second supporting arm and spaced from the second supporting arm on an opposite side thereof from the first supporting arm along the axis of vibration; and wherein:

the third line-segment lies along a second opposite projecting end of the second supporting arm; and the fourth line-segment lies along a projecting end of the third supporting arm.

15. A continuous-casting apparatus comprising:

a fixed mold-supporting device;

a continuous-casting mold;

a driver operative to oscillate the mold along an axis of vibration relative to the mold-supporting device; and a plurality of suspension structures for resiliently supporting the mold on the fixed mold-supporting structure, each suspension structure being comprised of:

first and second substantially rigid and parallel arms having respective first ends extending from opposite ends of a first substantially rigid connecting member to define a first generally U-shaped element with an open end defined by respective second ends of the first and second arms;

a third substantially rigid arm extending between the first and second arms, the third arm being in substantially parallel and spaced relationship to the first and second arms, and having first and second opposite ends, with the first end located adjacent to the first connecting member;

a first resilient guide element connected to the first arm adjacent to the first connecting member, and connected to the third arm adjacent to the second end thereof;

a second resilient guide element connected to the third arm adjacent to the first end thereof, and connected to the second arm adjacent to the second end thereof;

a first extension rigidly connectable to a carrying structure for the mold; and a second extension rigidly connectable to the fixed supporting structure, the suspension structures being so oriented that the respective first and second guide elements are substantially parallel to a line perpendicular to a centerline of the mold, each suspension structure having its first extension rigidly connected to the mold and its second extension rigidly connected to the mold supporting device.

16. The continuous-casting apparatus according to claim 15, further including:

a fourth substantially rigid arm having first and second opposite ends extending in substantially parallel spaced relationship to the third arm; and a second substantially rigid connecting member having first and second opposite ends, with the second end of the third arm extending from the first end of the second connecting member, and the first end of the fourth arm extending from the second end of the second connecting member, the third and fourth arms and the second connecting member defining a second U-shaped element having its arms interleaved with the arms of the first U-shaped element, and having the first and second connecting members in opposed relationship.

17. The suspension structure according to claim 16, wherein the first extension is connected to the second end of the first arm and the second extension is connected to the second end of the fourth arm.

18. The continuous-casting apparatus according to claim 15, wherein the first and second guide elements are comprised of substantially flat spring bands.

19. The continuous-casting apparatus according to claim 15, wherein the first and second guide elements are each comprised of an assembly of substantially flat spring bands.

20. A continuous casting apparatus according to claim 15, wherein the centerline of the mold is a straight line.

21. A continuous-casting apparatus according to claim 15, wherein the centerline of the mold is an arc of a circle, and the guide elements are oriented approximately on radial lines of the arc defined by the arcuate mold.

22. A continuous-casting apparatus comprising:

fixed mold-supporting device;

a continuous-casting mold;

a driver operative to oscillate the mold along a vibratory axis relative to the mold-supporting device;

a first group of first and second substantially parallel resilient guide elements that elastically support the mold on the mold-supporting device, the first and second substantially parallel resilient guide elements extending approximately transversely to the vibratory axis and spaced from each other in the direction of the vibratory axis, the first guide element being attached to the mold-supporting device at a first position and to the mold at a second position; and the second guide element being attached to the mold-supporting device at a third position and to the mold at a fourth position, the first and fourth positions being substantially at a first distance from a centerline of the mold, and the second and third positions being substantially at a second distance from a centerline of the mold; and a second group of first and second guide elements, the first and second groups of first and second guide elements being arranged in spaced relationship from one another along the axis of vibration.

23. A continuous-casting apparatus comprising:

a continuous casting mold;

a mold-supporting device;

a driver operative to oscillate the mold along an axis of vibration relative to the mold-supporting device;

a first group of first and second substantially parallel resilient guide elements that elastically support the mold on the mold-supporting device, the first and second guide elements being arranged in approximately parallel spaced relationship approximately transversely to the axis of vibration, opposed portions of the first and second guide elements being anchored along line segments thereof to the mold-supporting device and to the mold, and so oriented and connected that movement of the mold along the axis of vibration causes compressive stress in the guide elements to be substantially balanced whereby the guide elements are subjected primarily to tensile and bending stresses; and a second group of first and second guide elements, the first and second groups of first and second guide elements being arranged in spaced relationship from one another along the axis of vibration.

* * * * *